US005754984A

United States Patent [19]

Bermudez-Schmeelk

[11] Patent Number: 5,754,984

[45] Date of Patent: May 26, 1998

[54] DECORATIVE TOILET LID WITH CHANGEABLE DECORATIVE INSERT SHEETS

[76] Inventor: Camille Bermudez-Schmeelk, 16 Cliffside Acenue, Staten Island, N.Y. 10304

[21] Appl. No.: 497,810

[22] Filed: Jul. 3, 1995

[51] Int. Cl.[6] ..... A47K 13/14

[52] U.S. Cl. ..... 4/242.1

[58] Field of Search ..... 4/242.1, 234, 661

[56] References Cited

U.S. PATENT DOCUMENTS

| | | | |
|---|---|---|---|
| 1,189,767 | 7/1916 | Wilson | 4/234 |
| 3,484,876 | 12/1969 | Thomas | 4/234 |
| 5,086,521 | 2/1992 | Stewart | 4/242.1 X |
| 5,426,793 | 6/1995 | Mac | 4/242.1 X |
| 5,432,956 | 7/1995 | Park | 4/661 X |

*Primary Examiner*—Charles E. Phillips
*Attorney, Agent, or Firm*—Goldstein & Associates

[57] ABSTRACT

A decorative toilet lid for use with an original toilet seat lid or a replacement toilet lid. The decorative toilet lid comprises a core, along with a shell that covers the core, the shell being spaced from the core in order to accommodate a decorative insert sheet of choice. The decorative insert sheet can be selected from other materials used to decorate a bathroom. The decorative toilet lid may be configured to be snapped onto an existing lid, or a movable section of the shell may be provided to allow decorative insert sheets to be changed without removing the shell from the core.

7 Claims, 3 Drawing Sheets

DECORATIVE TOILET LID WITH CHANGEABLE DECORATIVE INSERT SHEETS

BACKGROUND OF THE INVENTION

This invention relates to decorative additions for use in a bathroom or lavatory. More particularly, the present invention relates to a decorative toilet lid for use with a toilet or water closet.

The desire to provide decorative accents to living and working spaces is well known. The use of such items can be purely for aesthetics, or can satisfy both decorative as well as functional needs. Common examples of materials and accents which are primarily decorative include paints, wall paper, assorted moldings and trims, as well as pictures and the like. Typical items which are utilized for both decorative and functional uses include blinds, curtains, and carpets.

Certain rooms are commonly configured for utility while allowing for expressive and decorative accenting. A primary example of such a room is a bathroom or lavatory. These rooms are furnished with mirrors, towel holders, shelving, shower curtains, and the like. Thus, an individual can choose from a large variety of colors, materials, textures, and styles when selecting these items. Accordingly, an individual can vary the motif of a bathroom significantly.

Virtually all bathrooms by fundamental design include wash basins and toilets. Although various items can be used to augment and accent these vital structures, they are limited. For example, toilets are often decorated and accented with covering items that typically slip over the toilet tank or toilet seat lid using various elastic securing means to maintain their position. Common types of covers are colored and made of plastic, cloth or carpet-like materials. Some include a sub-layer of padding. These items are usually simply applied over an existing structure. One problem that arises with covers constructed of cloth or carpet-like materials is their susceptibility to staining and discoloration. They can also become unsanitary and germ infested. These kinds of covers must be removed to be cleaned. Other common types of covers available are those made of soft plastic and vinyl materials. These have the same types of problems as discussed above, along with the problem of being susceptible to cuts and punctures.

Another fundamental problem with the above mentioned covers is their inability to exactly match other decorative accents used in the room. For example, the standard covering devices available are pre-configured with respect to texture and color. A potential user must select from a fixed number of choices. The possibility of matching another material used in the room, such as a wall paper or curtain material is not provided.

In some cases, devices are provided which replace existing portions of the toilet for decorative or functional reasons, or both. U.S. Pat. No. 4,932,084 to Hanson illustrates this. This invention is used to replace the toilet tank cover and incorporates a tissue holder, storage compartments, and the like. However, this device and others like it are also pre-configured and available only with fixed textures, patterns and colors.

Objects of the present invention are, therefore, to provide a new and improved type of decorative and functional accent, in the form of a decorative toilet lid, which can be used with a standard toilet, having one or more of the following capabilities and features:

provide a decorative accent that can be added to an existing toilet;

can be pre-configured with standard decorative patterns and colors;

can be custom configured to match other items already utilized in a bathroom;

provide a snap on shell to be used with standard toilet lid;

provide a decorative replacement toilet lid.

provide a durable, stain and scratch resistant surface;

capable of being cleaned and disinfected while installed on the toilet.

SUMMARY OF THE INVENTION

In accordance with the invention, a decorative toilet lid is provided that comprises a core that is generally flat having a top surface, a bottom surface and a side surface. Also included is a transparent shell having an inner surface and an outer surface, the shell overlaying the core. The shell is also spaced from the top surface of the core, thereby providing a gap between the inner surface of the shell and the top surface of the core, with a decorative insert sheet contained within the gap.

In accordance with another aspect of the invention, a second embodiment of the invention provides a decorative toilet lid wherein the shell further comprises a movable section which provides access to the gap, thereby allowing the decorative toilet lid to be easily configured with a decorative insert sheet of choice.

For a better understanding of the invention, together with other and further objects, reference is made to the accompanying drawings, with the scope pointed out in the appended claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

It should be noted that the following description of the preferred embodiments, and the related examples given, should be considered as exemplars, rather than limitations on the present invention.

Figure 1:
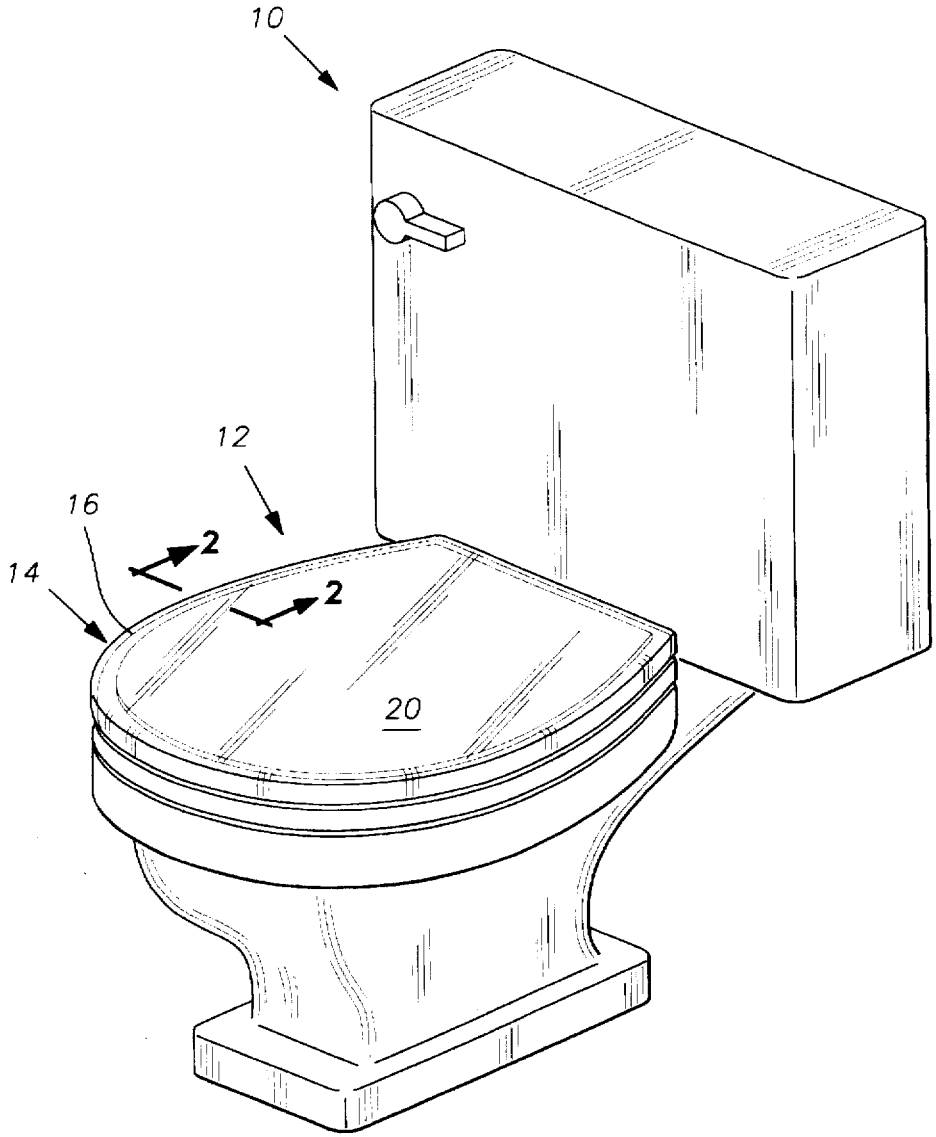
FIG. 1 illustrates a perspective drawing of a toilet with a decorative toilet lid installed thereon.

Referring now to FIG. 1, there is illustrated a toilet 10 with a decorative toilet lid 12 installed thereon. The decorative toilet lid 12 is substantially horse-shoe shaped and is generally flat. A core 16 is overlaid by a shell 14, and a decorative insert sheet 20 is placed between the core 16 and the shell 14.

Figure 2:
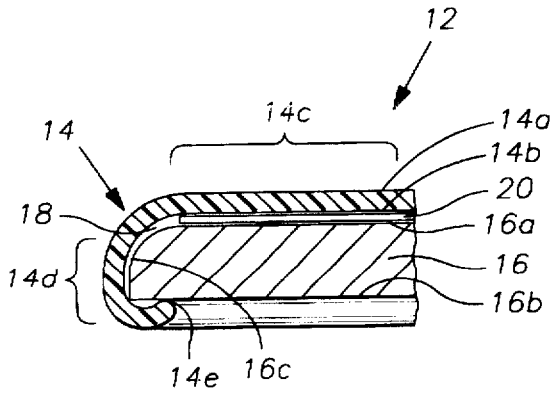
FIG. 2 shows a partial cross sectional view of an embodiment of the decorative toilet lid taken along the line 2—2 of FIG. 1.

Referring now to FIG. 2 there is provided a partial cross section of the embodiment of the decorative toilet lid 12 illustrated in FIG. 1, taken along the line 2—2. Shown is the core 16, having a top surface 16*a*, a bottom surface 16*b* and a side surface 16*c*. Also shown is the shell 14, having an outer surface 14*a* and an inner surface 14*b*. Furthermore, the shell is transparent and is comprised of a top shell portion 14*c* and a side shell portion 14*d*. The shell 14 overlays the core 16 in such a manner that the top shell portion 14*c* overlays the top surface 16*a* of core 16, and the side shell portion 14*d* overlays the side surface 16*c* of the core 16. The shell 14 is spaced from the top surface 16*a* of the core 16 so as to provide a gap 18.

The toilet lid 12 as shown in FIG. 2 further comprises the decorative insert sheet 20, which is located between the top surface 16*a* of the core 16 and the inner surface 14*b* of the top shell portion 14*c* (i.e., in the gap 18). An arrangement for securing the shell 14 to the core 16 may be provided by a curled end portion 14*e* fixed to the lower edge of the side shell portion 14*d*. With this arrangement the curled end portion 14*e* is configured to grasp the outer perimeter of the bottom surface 16*b* of the core 16. It is important to note that the curled end portion 14*e* is configured to allow the shell 14 to snap onto the core 16. It should also be noted that the core 16 may be the original toilet lid cover, or may be a replacement lid.

Figure 3:
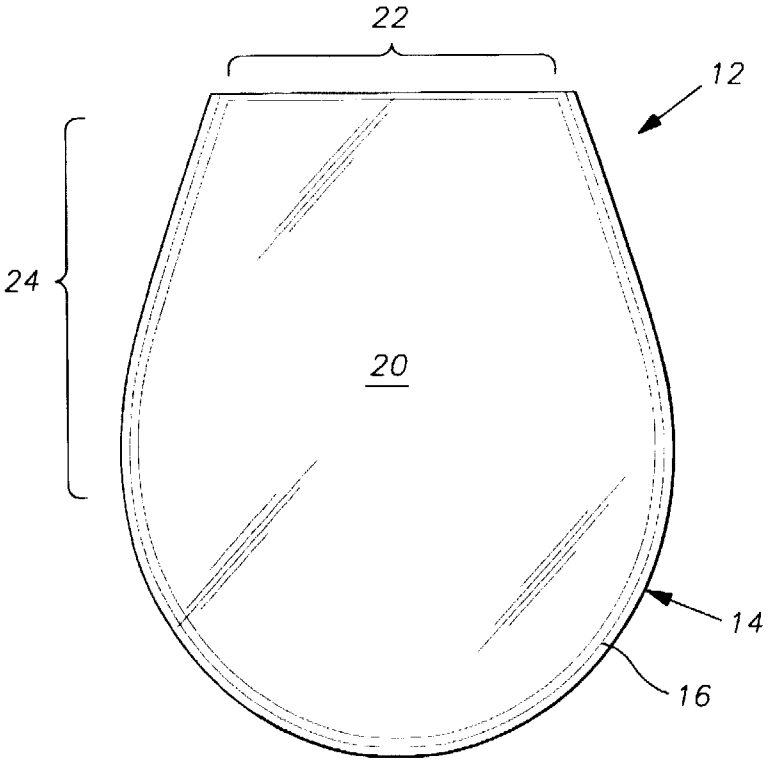
FIG. 3 provides a top plan view of an embodiment of the present invention.
Figure 4:
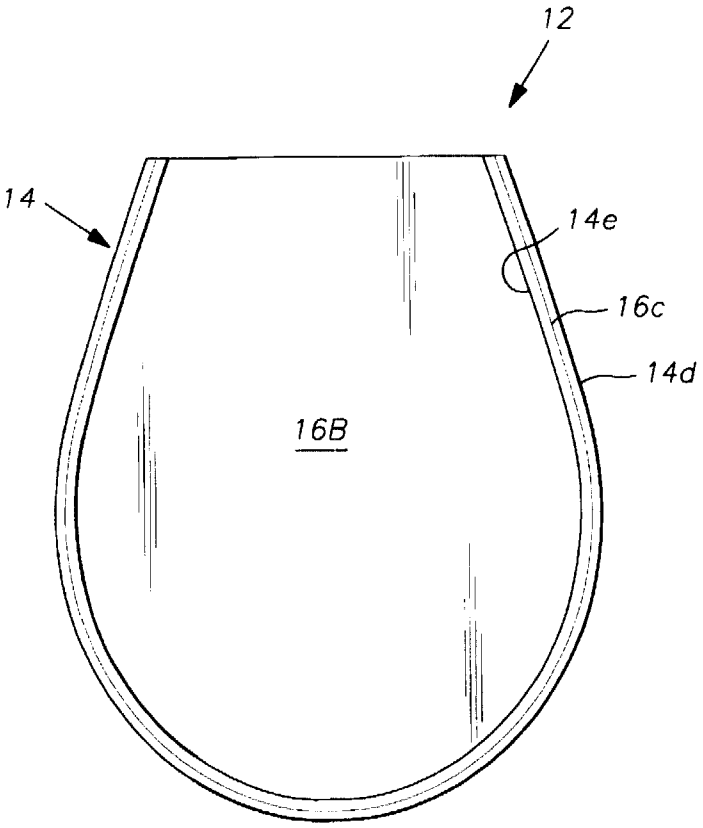
FIG. 4 provides a bottom plan view of the embodiment shown in FIG. 3.

Referring now to FIGS. 3 and 4 there is illustrated two plan views of the first embodiment of the invention. FIG. 3 provides a top view of the decorative toilet lid 12, showing an outline with a flat region 22, and a curved region 24 which forms the remaining portion of the outline. The view given in FIG. 3 further provides three superimposed layers including the shell 14 transparently covering the decorative insert sheet 20, which in turn substantially covers the core 16. FIG. 4 provides a bottom view of the decorative toilet lid 12. Shown is the bottom surface 16*b* and the side surface 16*c* of the core 16, along with the side shell portion 14*d* and the curled end portion 14*e* of the shell 14.

Figure 5:
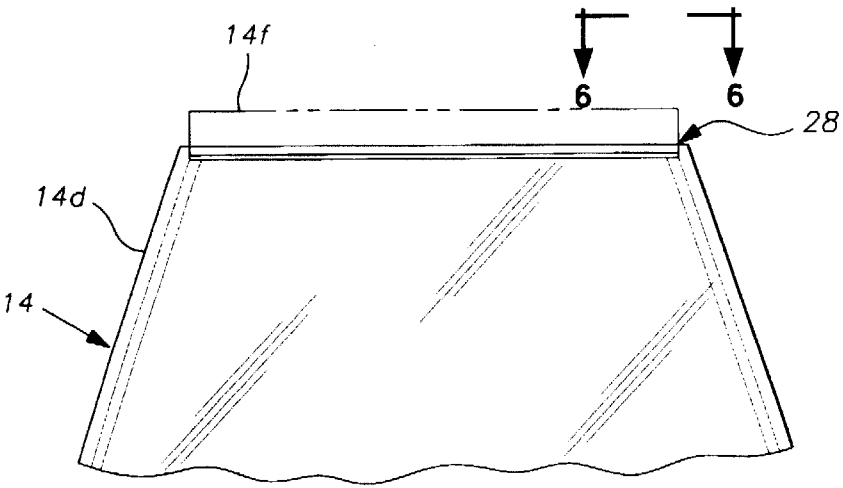
FIG. 5 presents a partial top plan view of another embodiment of the invention.

Turning to FIG. 5 there is provided a partial plan view of another embodiment of the present invention. Further included in this embodiment is a moveable section 14*f* of the side shell portion 14*d*. The movable section 14*f* is mounted using hinge means 28, and is movable between an open position and a closed position. By referring to FIG. 6, it can be seen that when the movable section 14*f* is in the closed position, the decorative insert sheet 20 is maintained within the gap 18.

It should be noted that although shell 14 is described as being transparent, it is contemplated that it may be frosted or etched. This would provide a decorative visual affect as well as helping to hide scratches and other imperfections in the shell 14.

Figure 6:
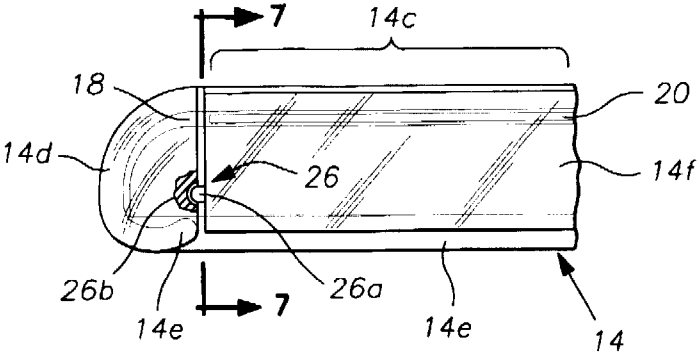
FIG. 6 is a partial view of the embodiment of FIG. 5 taken along the line 6—6.

Further reference to FIG. 6 illustrates an elongated partial view of the second embodiment taken along line 6—6 in FIG. 5. Clearly shown is the top shell portion 14*c*, the side shell portion 14*d*, and the curled end portion 14*e*. Further illustrated in FIG. 6 is movable section 14*f* of the shell 14, shown in the closed position. A closure arrangement 26 is provided to secure movable section 14*f* in the closed position. The closure arrangement 26 may be comprised of a raised bump 26*a* and a mating dimple 26*b*. When the movable section 14*f* is in the closed position, bump 26*a* and dimple 26*b* are engaged and movable section 14*f* is secured in the closed position.

Figure 7:
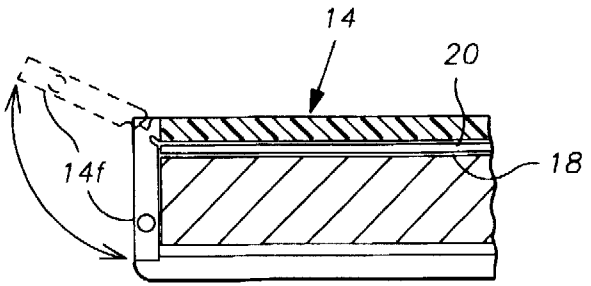
FIG. 7 is a partial cross sectional view of the embodiment of FIG. 6 along the line 7—7.

FIG. 7 provides a cross sectional view along line 7—7 in FIG. 6. Illustrated is a side view of the movable section 14*f*, clearly showing said moveable section 14*f* in the open position and the closed position. The gap 18 is also shown, with the decorative insert sheet 20 located therein. The decorative insert sheet 20 may be inserted into and removed from the gap 18 when the moveable section 14*f* is in the open position.

It is important to note that the invention embodied in the forms illustrated in the accompanying drawings and described in the foregoing text are intended to be illustrative only. Variations are contemplated as being a part of the present invention, limited only by the scope of the appended claims.

What is claimed is:

1. A decorative toilet lid, comprising:

a core, said core being generally flat and having a top surface, a bottom surface, and a side surface;

a hard, durable, and substantially transparent shell having an inner surface and an outer surface, said shell being comprised of a top shell portion and a side shell portion; said top shell portion overlaying said top surface of said core and said side shell portion overlaying said side surface of said core; said top shell portion being slightly spaced from said core thereby providing a gap between said inner surface of said shell and said top surface of said core;

a decorative insert sheet suitable for placement within said gap so as to substantially cover said top surface of said core, said insert sheet provided to enable the decorative toilet lid to be configured with a selected decorative insert sheet that is viewable through the transparent shell to enable the toilet lid to be custom configured; and means to enable said decorative insert sheet to be positioned within said gap between said top surface of said core and said inner surface of said shell.

2. The decorative toilet lid according to claim 1, wherein said means to enable said decorative insert sheet to be positioned within said gap is provided by a shell configured to snap onto and off of said core, thereby enabling said shell to be removed from said core to position said decorative insert sheet on top of said core, and subsequently enable said shell to be snapped back onto said core.

3. The decorative toilet lid according to claim 2, wherein said core is substantially horse-shoe shaped and said side portions of said shell have end portions that are suitably curled to removably secure said shell to said core so as to enable said shell to be removed from said core.

4. The decorative toilet lid according to claim 3, wherein at least one of the inner surface and the outer surface of said shell is at least partially etched to hide scratches and other imperfections in said shell, while still enabling said decorative insert sheet to be viewed therethrough.

5. A decorative toilet lid enabling the display of selected decorative accents , said decorative toilet lid comprising:

a core that is generally flat, said core having a top surface, a bottom surface, and a side surface;

a durable, scratch resistant, and substantially transparent shell having an inner surface and an outer surface, said shell being comprised of a top shell portion and a side shell portion, with said top shell portion overlaying said top surface of said core and said side shell portion overlaying said side surface of said core; said top shell portion being slightly spaced from said core thereby providing a gap between said inner surface of said shell and said top surface of said core; and a decorative insert sheet securely contained within said gap and substantially covering said top surface of said core, said decorative insert sheet provided to enable the toilet lid to be configured with a decorative accent that is viewable through the transparent shell;

said shell configured to snap-on to said core, thereby enabling said shell to be removed from said core, enabling one of either inserting said decorative insert sheet and changing said decorative insert sheet, wherein said shell may subsequently be snapped again onto said core.

6. The decorative toilet lid according to claim 5, wherein said side portions of said shell have end portions that are suitably curled to removably secure said shell to said core so as to enable said shell to selectively be secured to said core and to be removed from said core.

7. The decorative toilet lid according to claim 5, wherein said shell is at least partially etched to hide scratches and other imperfections in said shell, while still enabling said decorative insert sheet to be viewed therethrough.

* * * * *